US007156456B1

(12) United States Patent
Chen

(10) Patent No.: US 7,156,456 B1
(45) Date of Patent: Jan. 2, 2007

(54) FOLDABLE CHAIR

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 11/507,980

(22) Filed: Aug. 22, 2006

(51) Int. Cl.
*A47C 3/029* (2006.01)

(52) U.S. Cl. ..... 297/32; 297/35; 297/271.4; 297/16.1

(58) Field of Classification Search ..... 297/16.1, 297/20, 32, 35, 40, 47, 51, 54, 271.3, 271.4, 297/271.5, 271.6
See application file for complete search history.

(56) References Cited

U.S. PATENT DOCUMENTS 389,572 A * 9/1888 Holden ..... 297/32
444,992 A * 1/1891 Pohl ..... 297/271.4
514,445 A * 2/1894 Cornell ..... 297/32
1,711,371 A * 4/1929 Zentmyer ..... 297/32
2,715,937 A * 8/1955 Thomas ..... 297/32
5,570,926 A * 11/1996 Papiernik et al. ..... 297/39
6,471,287 B1 * 10/2002 Liu ..... 297/35
6,676,206 B1 * 1/2004 Brandschain ..... 297/271.4

* cited by examiner

*Primary Examiner*—Peter R. Brown
(74) *Attorney, Agent, or Firm*—Frenkel & Associates

(57) ABSTRACT

A foldable chair has a supporting shaft assembly, a frame assembly, a connecting shaft assembly and a cushion mounted on the frame. The supporting shaft assembly has two parallel rockers connected by multiple transverse shafts and four curved shafts rotatably mounted respectively on ends of the rockers. Thus, the foldable chair can be used as a general chair or a rocking chair. A frame assembly has two seat bars, a backrest bar pivotally mounted on the seat bars, a foot bar and two armrests pivotally mounted on the foot bars. The connecting shaft assembly has two rear shafts and two front shafts all connected with the seat bars and the rockers and further has two positioning boards mounted on the rockers and each positioning board has detents. The rotatable curved shafts on the rockers allow the foldable chair to be used as a general chair or a rocking chair.

6 Claims, 10 Drawing Sheets

FOLDABLE CHAIR

BACKGROUND OF THE INVENTION

1. Field of Invention

The present invention relates to a foldable chair, and more particularly to a foldable chair that is a rocking chair and is easily folded for storing or transporting.

2. Description of the Related Art

Conventional rocking chairs mostly are not foldable, so storing or transporting the rocking chairs are inconvenient. If a chair is foldable and can be used as a general chair and a rocking chair, this will satisfy users' need.

To overcome the shortcomings, the present invention provides a foldable chair to mitigate or obviate the aforementioned.

SUMMARY OF THE INVENTION

The primary objective of the present invention is to provide a foldable chair that is a rocking chair and is easy to be folded to store or move.

To achieve the objective, the foldable chair has a supporting shaft assembly, a frame assembly, a connecting shaft assembly and a cushion. The supporting shafts assembly has two parallel rockers connected by multiple transverse shafts and four curved shafts rotatably mounted respectively on ends of the rockers. Thus, the foldable chair can be used as a general chair or a rocking chair. A frame assembly has two seat bars, a backrest bar, a foot bar and two armrests. The backrest bar is mounted pivotally on the seat bars. The armrests are mounted pivotally on the foot bars by two adjusting devices. The connecting shaft assembly has two front shafts, two rear shafts, two positioning boards and a fastening shaft. The front and rear shafts connect with the seat bars and the rockers. The positioning boards mounted on the rockers and each positioning board has a detent. The fastening shaft connects with the rear shafts and is mounted in the detents to control a part of the foldable chair to be folded or unfolded. The cushion is mounted between the backrest bar, the seat bars and the foot bar.

Other objectives, advantages and novel features of the invention will become more apparent from the following detailed description when taken in conjunction with the accompanying drawings.

DETAILED DESCRIPTION OF THE INVENTION

Figure 1:
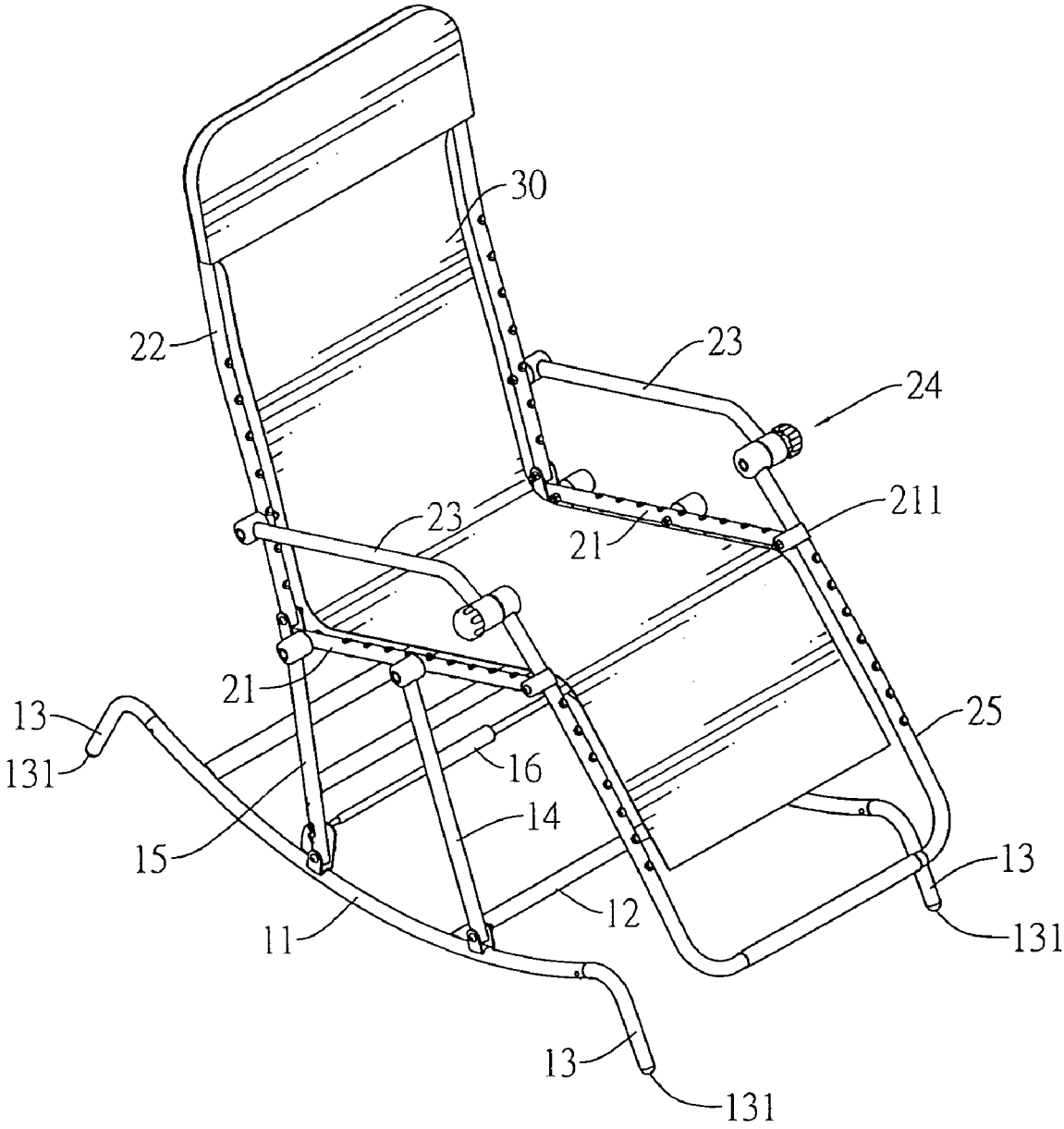
FIG. 1 is a perspective view of a foldable chair in accordance with the present invention, which is used as a general chair.
Figure 2:
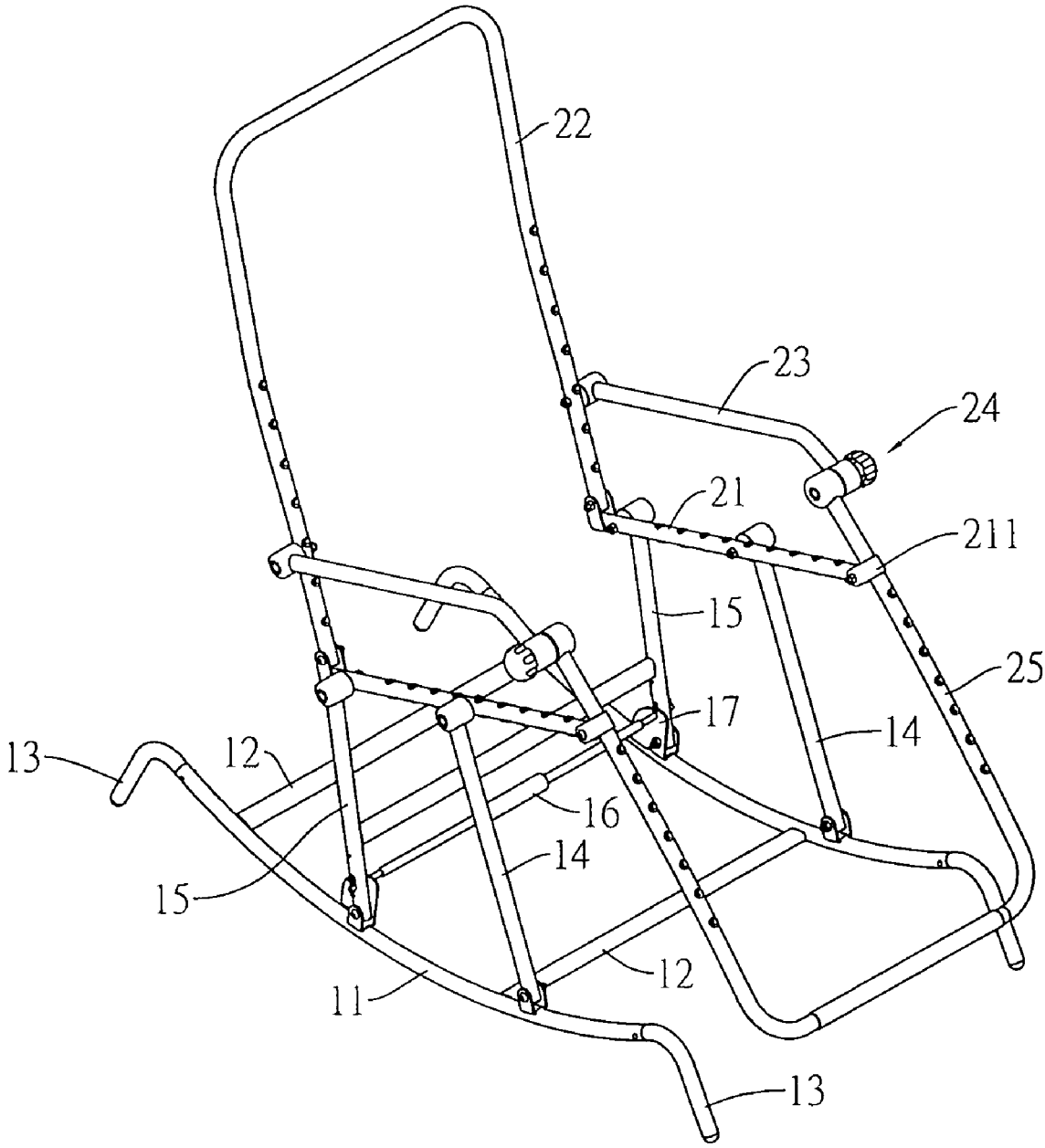
FIG. 2 is a perspective view of the foldable chair without a cushion in FIG. 1.
Figure 3:
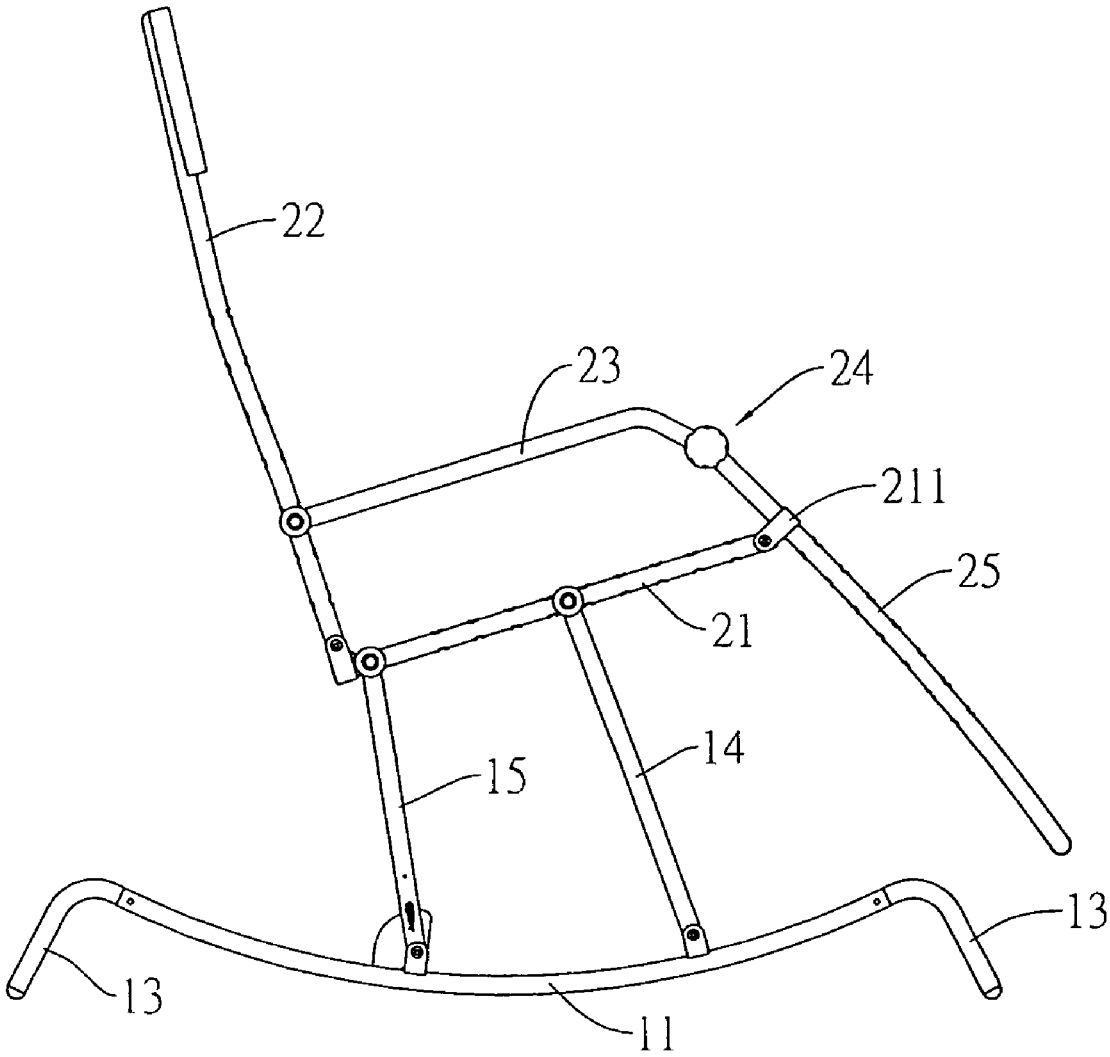
FIG. 3 is a side view of the foldable chair in FIG. 1.

With reference to FIG. 1, a foldable chair in accordance with the present invention has a supporting shaft assembly, a frame assembly, a connecting shaft assembly and a cushion (30).

With further reference to FIGS. 2, 3, 7 and 8, the supporting shaft assembly stands on ground and has two parallel rockers (11), multiple parallel transverse shafts (12) and four curved shafts (13). Each rocker (11) is curved and has two ends. Each end of the rocker (11) has a first hole and a second hole. The second hole is mounted opposite to the first hole. The transverse shafts (12) connect with and are mounted between the rockers (11). The curved shafts (13) corresponding to the ends of the rockers (11) and each curved shaft (13) has a proximal end and a distal end (131). The proximal ends of the curved shafts (13) are rotatably mounted respectively on the ends of the rockers (11) and has a resilient protrusion. The resilient protrusion selectively protrudes in the first hole or the second hole of the end of the rockers (11). The distal ends (131) may face downwards or upwards when the resilient protrusions protrudes in the first hole or the second hole. The foldable chair stands with the four downward distal ends (131) of the curved shaft (13) when the foldable chair is used as a general chair. When the distal ends (131) face upwards, the foldable chair stands with the rockers (11) and the foldable chair is used as a rocking chair.

Figure 9:
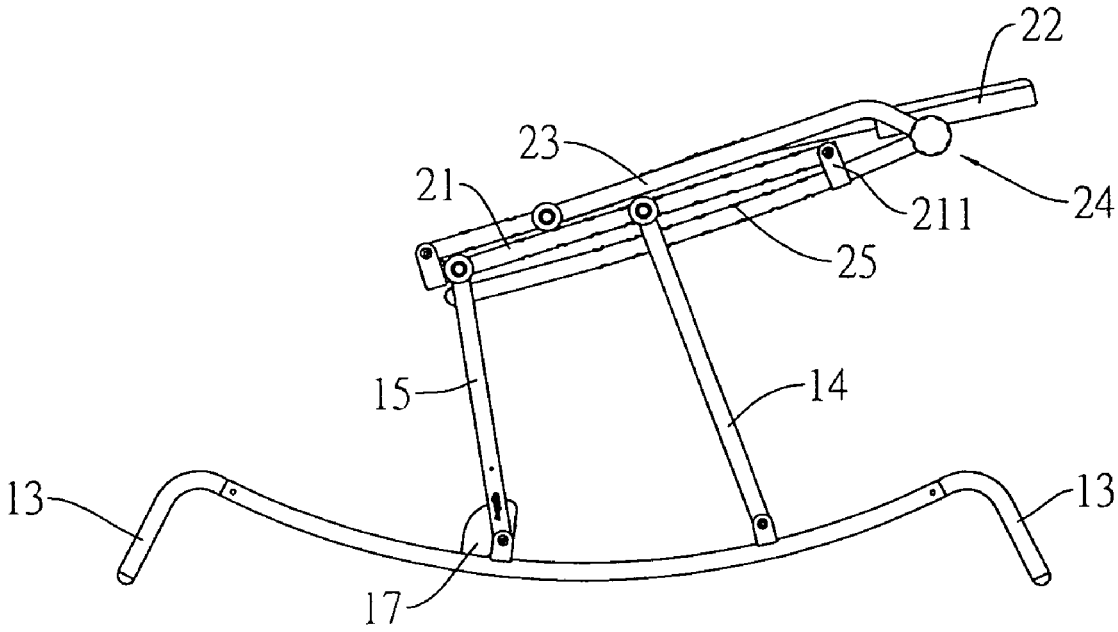
FIG. 9 is a perspective view of the foldable chair in FIG. 1, which is partially folded.
Figure 10:
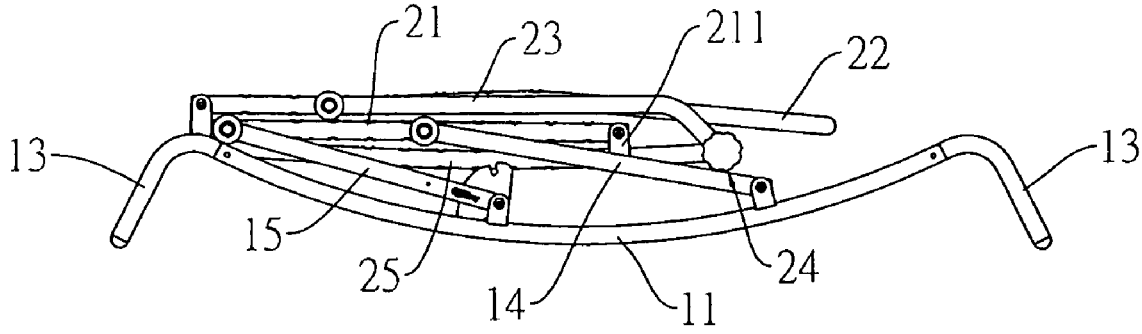
FIG. 10 is a perspective view of the foldable chair in FIG. 1, which is completely folded.

With further reference to FIG. 9, the frame assembly has two seat bars (21), a backrest bar (22), a foot bar (25), two armrests (23) and two adjusting devices (24).

Each seat bar (21) has a proximal end, a distal end and a pivotal bracket (211). The pivotal bracket (211) is mounted pivotally on the distal end of the seat bar (21).

The backrest bar (22) is reversed U-shaped and has two ends and two outer sides. The ends of the backrest bar (22) are pivotally mounted respectively on the proximal ends of seat bar (21).

Figure 6:
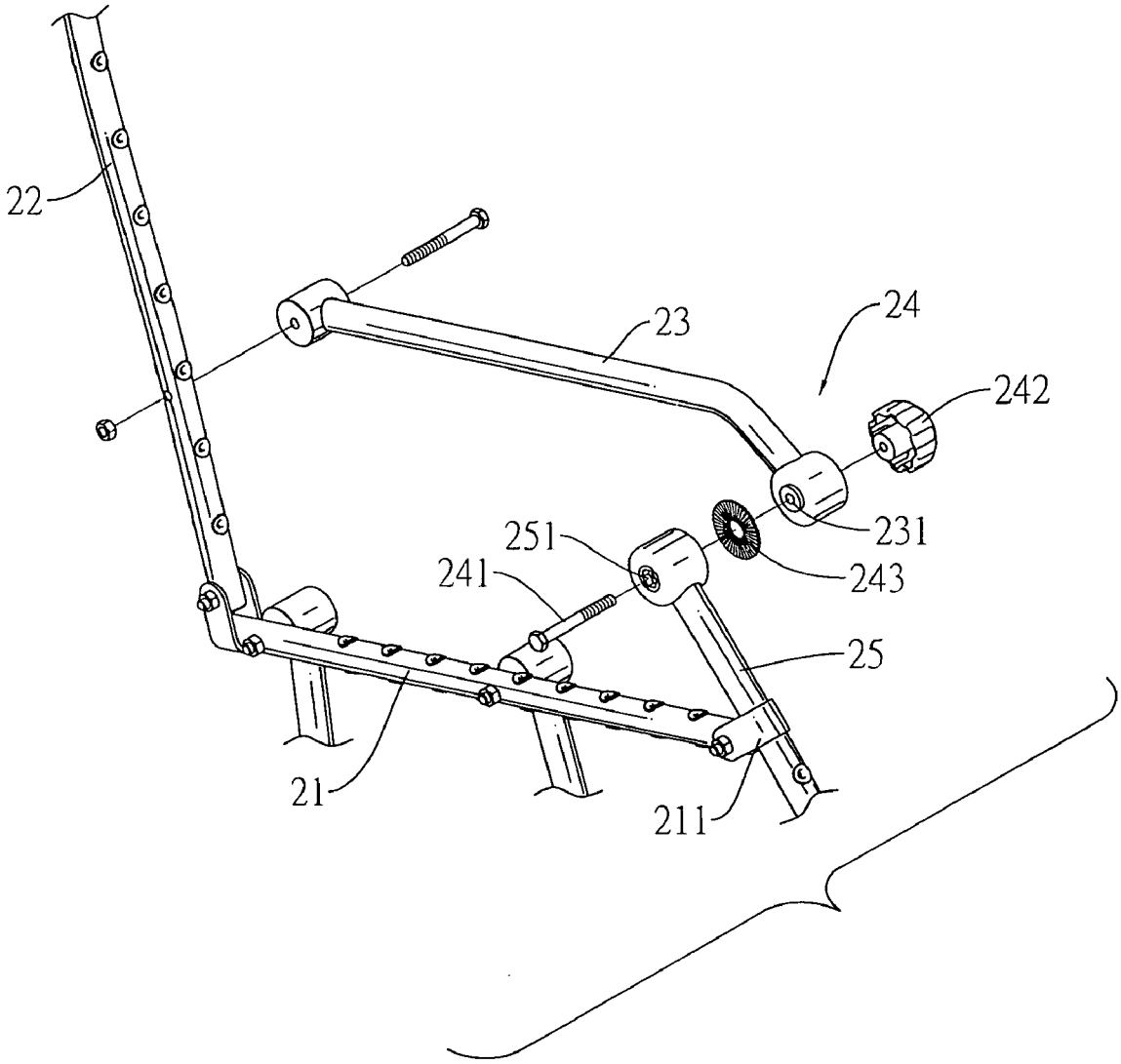
FIG. 6 is an exploded perspective view of a positioning assembly of the foldable chair in FIG. 1.
Figure 7:
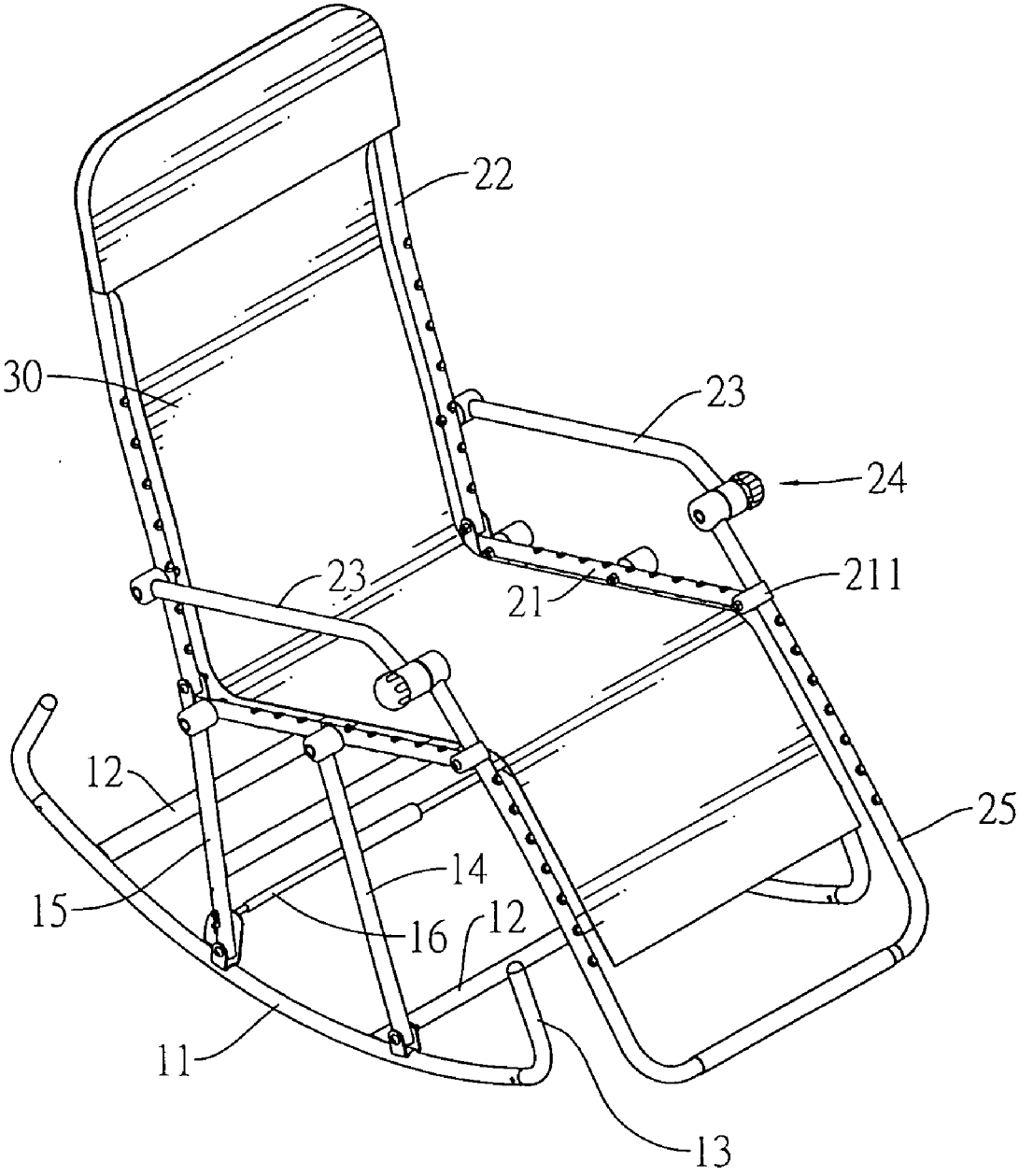
FIG. 7 is a perspective view of a foldable chair in FIG. 1, which is used as a rocking chair.
Figure 8:
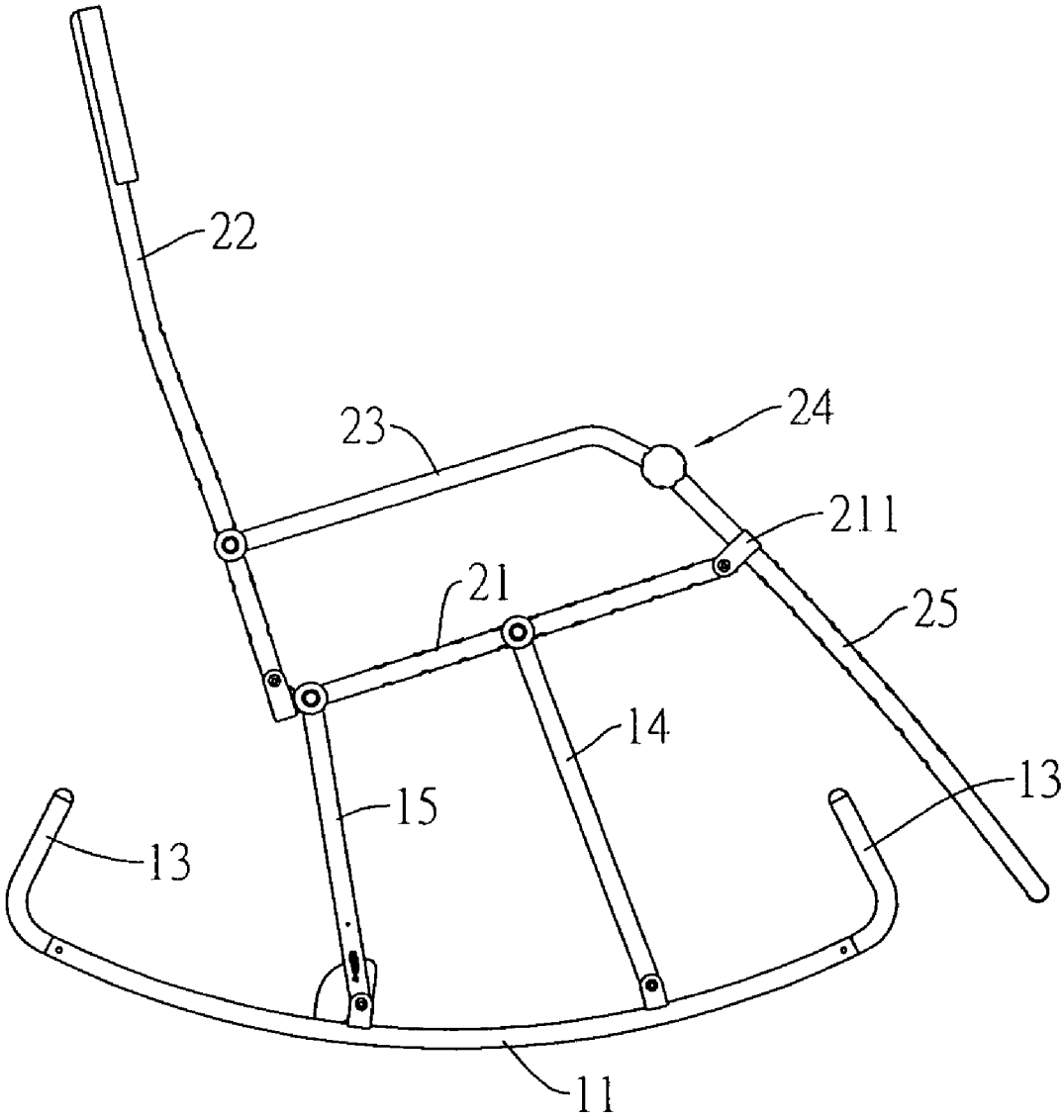
FIG. 8 is a side view of the foldable chair in FIG. 7.

With further reference to FIG. 6, the foot bar (25) is U-shaped, is mounted pivotally on the seat bars, may be mounted securely on the pivotal brackets (211) of the seat bars (21) and has two ends. The two ends respectively extend through the pivotal brackets (211) and each end has a through hole (251) defined transversely through the end and an outer surface.

The armrests (23) are mounted on the backrest bar (22) above the seat bars (21) and each armrest (23) has a proximal end and a distal end. The proximal ends of the armrests (23) are pivotally mounted respectively on the outer sides of the backrest bar (22). The distal ends of the armrests (23) are pivotally mounted respectively on the foot bars (25) and each distal end has a hole (231) defined transversely the distal end and an outer surface.

Each adjusting device (24) selectively fastens a corresponding armrest (23) securely on the foot bar (25) or pivotally connect the armrests (23) with the foot bars (25) to adjust an angle between the armrests (23) and the foot bars (25). Each adjusting device (24) has a threaded rod (241), a nut (242) and a spacer (243). The threaded rod (241) extends through the through hole (251) in a corresponding end of the foot bar (25) and into the hole (231) of a corresponding armrest (23) and has an enlarged inside end and an outside end. The enlarged inside end abuts the outer surface of the corresponding end of the foot bar (25). The nut (242) screws on the outside end of the threaded rod (241) and abuts the outer surface of the distal end of the corresponding armrest (23). The spacer (243) is mounted between the distal end of the corresponding armrest (23) and the corresponding end of the foot bar (25).

Figure 4:
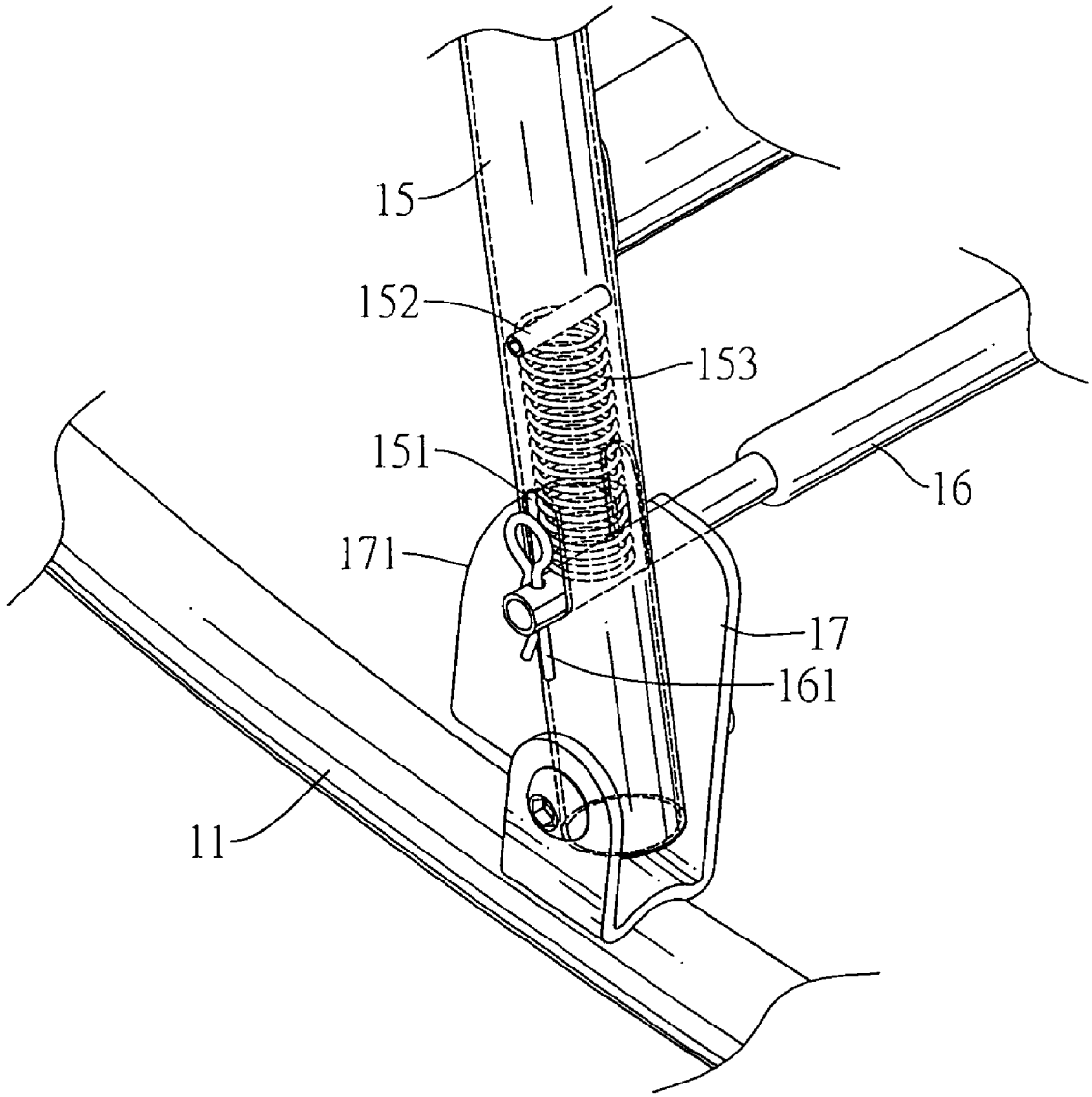
FIG. 4 is an enlarged perspective view of a fastening shaft mounted on a positioning board and a rear shaft of the foldable chair in FIG. 1.
Figure 5:
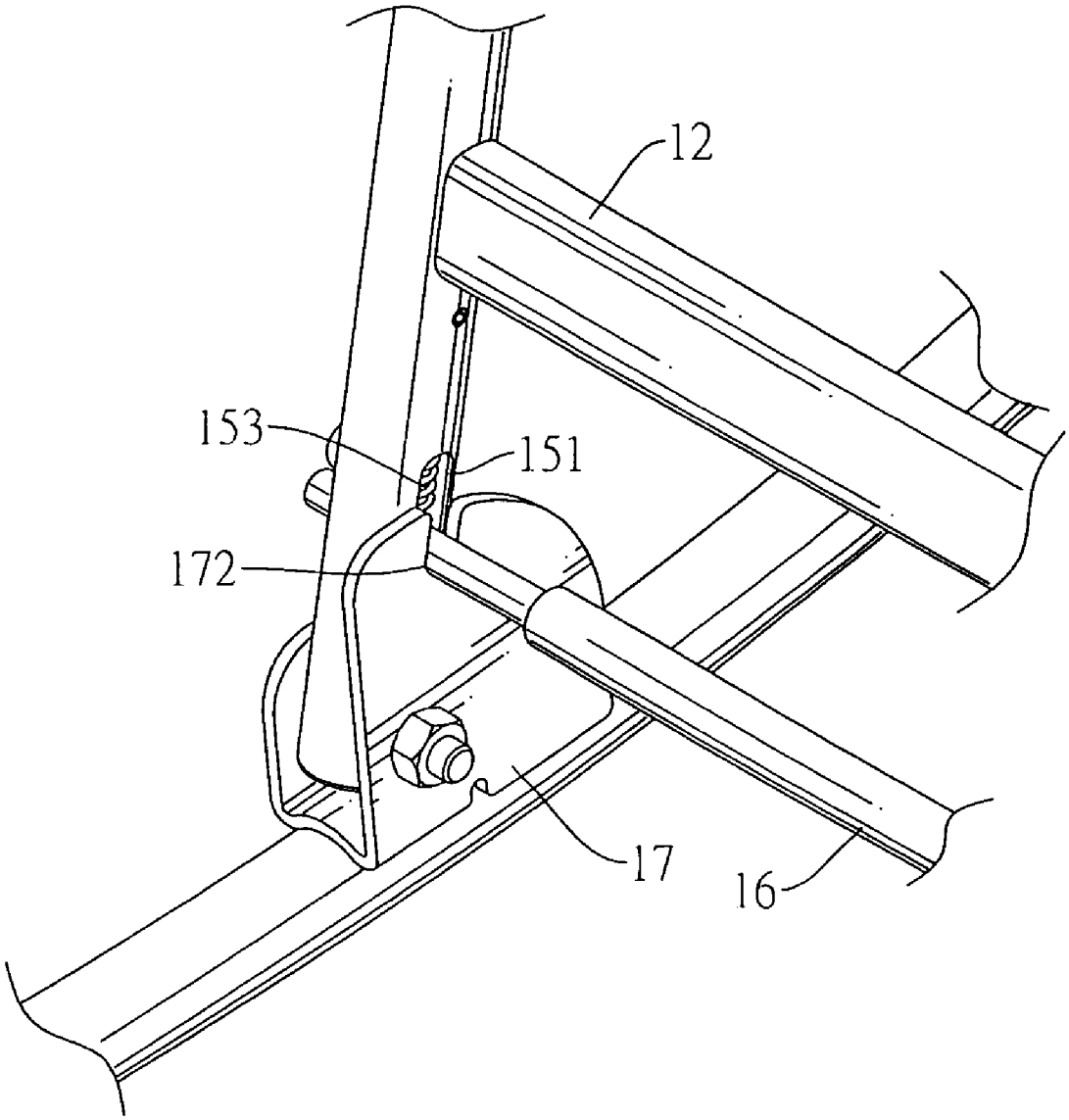
FIG. 5 is another enlarged perspective view of the fastening shaft mounted on the positioning board and the rear shaft of the foldable chair in FIG. 4.

With further reference to FIGS. 4 and 5, the connecting shaft assembly has two front shafts (14), two positioning board (17), a fastening shaft (16), two rear shafts (15) and two bolts (161).

Each front shaft (14) has a lower end and an upper end. The lower end is mounted pivotally on the rocker (11). The upper end is mounted pivotally on the seat bar (21).

The positioning boards (17) are securely mounted respectively on the rockers (11) and each positioning board (17) has a detent (172) and a curved edge (171). The detent (172) is defined in the positioning board (17).

The fastening shaft (16) has two ends. Each end selectively engages in the detent (172) of the positioning board (17) or disengages from the detent (172) to move along the curved edge (171) of the positioning board (17). Each end further has a positioning hole. The positioning hole is defined transversely through the end of the fastening shaft (16).

Each rear shaft (15) is hollow and has an inner space, a lower end, an upper end, two openings (151), a stop (152) and a spring (153). The lower end is mounted pivotally on a corresponding positioning board (17). The upper end is mounted pivotally on the proximal end of a corresponding seat bar (21). The openings (151) are longitudinal, are aligned with each other, correspond to the detent (172) of the corresponding positioning board (17) and are formed in opposite through the rear shaft (15). The openings (151) allow a corresponding end of the fastening shaft (16) to extend through the openings (151) and selectively move along the openings (151). Each stop (152) is mounted securely in the inner space and is above the openings (151). The spring (153) are mounted between the stop (152) and the fastening shaft (16). When the spring (153) presses the fastening shaft (16) and the fastening shaft (16) is mounted in the detent (171), the foldable chair stands firmly and can not be folded. When the spring (153) is compressed by the fastening shaft (16) that moves upward along the openings (151), the fastening shaft (16) will disengage from the detent (172) and move along the curved edge (171) to abut the rocker (11), then the foldable chair will be folded.

The bolts (161) are mounted respectively through the positioning holes in the ends of the fastening shaft (16) to allow the fastening shaft (16) to be mounted in the opening (151) stably.

With further reference to FIG. 1, the cushion (30) is mounted between the backrest bar (22), the seat bars (21) and the foot bar (25) and has a fastener. The cushion (30) may be made of a resilient material such as cloth, rattan or the like. The fastener may be a string to fasten the cushion between the backrest bar (22), the seat bars (21) and the foot bar (25).

The foldable chair can be used as a general chair or a rocking chair by turning the curved shaft (13), so it is convenient for people. The chair can be folded or unfolded easily by moving the fastening shaft (16) out of the detent (172) of the positioning board (17) and unscrewing the nut (242) on the threaded rod (251). When folded, the foldable chair becomes compact to allow a user to store and transport easily the foldable chair.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A foldable chair comprising:

a supporting shaft assembly adapted for standing on ground and having
- two parallel rockers;
- multiple parallel transverse shafts connecting with and mounted between the rockers;

a frame assembly having
- two seat bars, and each seat bar having
  - a proximal end; and
  - a distal end;
- a backrest bar having
  - two ends pivotally mounted respectively on the proximal ends of seat bar; and
  - two outer sides;
- a foot bar mounted pivotally on the seat bars and having two ends;
- two armrests mounted on the backrest bar above the seat bars and each armrest having
  - a proximal end pivotally mounted on one of the outer sides of the backrest bar; and
- two adjusting devices connecting and mounted between the armrests and the foot bar and each selectively fastening one of the armrests securely on the foot bar or pivotally connecting one of the armrests with a corresponding one of the foot bars to adjust an angle between the corresponding armrest and the foot bar;

a connecting shaft assembly having
- two front shafts, and each front shaft having
  - a lower end pivotally mounted on the rocker; and
  - an upper end pivotally mounted on the seat bar;
- two positioning boards securely mounted respectively on the rockers and each positioning board having a detent defined in the positioning board;
- a fastening shaft having two ends selectively engaging in the detents of the positioning boards;
- two rear shafts being hollow and each rear shaft having
  - a lower end pivotally mounted on one of the positioning boards;
  - an upper end pivotally mounted on the proximal end of one of the seat bars;
  - two openings being longitudinal, aligned with each other, corresponding to the detent of a corresponding positioning board, formed through the rear shaft and allowing one end of the fastening shaft to extend through the openings and selectively move along the openings; and a cushion mounted between the backrest bar, the seat bars and the foot bar.

2. The foldable chair as claimed in claim 1, wherein each rockers has
- two ends; and
- four curved shafts corresponding respectively to the ends of the rockers and each curved shaft having
  - a proximal end rotatably mounted on one of the ends of a corresponding rocker; and a distal end adapted for selectively standing on the ground.

3. The foldable chair as claimed in claim 1, wherein each seat bar further has a pivotal bracket mounted pivotally on the distal end of the seat bar;

the foot bar is mounted securely on the pivotal brackets and the two ends of the foot bar respectively extend through the pivotal brackets.

4. The foldable chair as claimed in claim 1, wherein each armrest has a distal end having a hole defined transversely the distal end; and an outer surface;

each end of the foot bar further has a through hole defined transversely through the end; and an inner surface;

each adjusting device has a threaded rod extending in the through hole in a corresponding end of a corresponding foot bar and the hole of a corresponding armrest and having an enlarged inside end abutting the inner surface of the corresponding end of the corresponding foot bar; and an outside end;

a nut screwing on the outside end of the threaded rod and abutting the outer surface of the distal end of the corresponding armrest; and a spacer mounted between the distal end of the corresponding armrest and the corresponding end of the corresponding foot bar.

5. The foldable chair as claimed in claim 1, wherein each positioning board further has a curved edge;

each rear shafts is hollow and further has an inner space;

a stop mounted securely in the inner space and above the openings; and a spring mounted between the stop and the fastening shaft.

6. The foldable chair as claimed in claim 1, wherein each end of the fastening shaft further has a positioning hole defined transversely through the end of the fastening shaft; and the connecting shaft assembly further has two bolts respectively mounted through the positioning holes in the ends of the fastening shaft.

* * * * *